US010900624B1

(12) United States Patent
Mullen

(10) Patent No.: US 10,900,624 B1
(45) Date of Patent: Jan. 26, 2021

(54) VERSATILE WALL MOUNT

(71) Applicant: Nate Mullen, Valley Center, CA (US)

(72) Inventor: Nate Mullen, Valley Center, CA (US)

( * ) Notice: Subject to any disclaimer, the term of this patent is extended or adjusted under 35 U.S.C. 154(b) by 0 days.

(21) Appl. No.: 16/535,449

(22) Filed: Aug. 8, 2019

(51) Int. Cl.
*F21S 8/00* (2006.01)

(52) U.S. Cl.
CPC ..... *F21S 8/036* (2013.01)

(58) Field of Classification Search
CPC ..... F21S 8/036; F21S 8/033; F21S 8/035; F21W 2131/109; F21V 21/02; F21V 21/10; F21V 21/104; F21V 21/108; F21V 21/112; F21V 21/116
USPC ..... 362/147
See application file for complete search history.

(56) References Cited

U.S. PATENT DOCUMENTS 881,284 A * 3/1908 Atkinson

* cited by examiner

*Primary Examiner* — Matthew J. Peerce
(74) *Attorney, Agent, or Firm* — Kelly & Kelley, LLP

(57) ABSTRACT

A wall mounting bracket for a light fixture. The mounting bracket has an oblong body defined by oppositely disposed, generally parallel upper and lower surfaces. A mounting surface is disposed at one end of the oblong body, generally perpendicular to the upper and lower surfaces. A stem port passes through the body from the upper surface to the lower surface. A transverse port passes through the oblong body from the mounting surface to the stem port. The stem port has threaded openings in each of the upper and lower surfaces for receiving mounting stems from light fixtures. The mounting surface may be attached to a wall in any orientation or rotation so as to permit light fixtures to be oriented to one or both sides of the bracket.

11 Claims, 8 Drawing Sheets

VERSATILE WALL MOUNT

BACKGROUND OF THE INVENTION

The present invention is directed to a wall mount for a light fixture. More particularly, the inventive wall mount provides a low-profile device for mounting a light fixture, while providing for greater concealment of electrical wires and permitting optional installment in one or both of two opposite directions.

Wall mounts for light fixtures are known in the art. However, such prior art wall mounts have notable drawbacks, including but not limited to, a single mounting orientation, a mounting orientation generally perpendicular to the mounting surface, and exposed or otherwise visible electrical wires. Accordingly, there is a need for a light fixture wall mount that more easily and reliably conceals electrical wires, provides installation orientations that are other than perpendicular to a wall surface, and provides options for single or multiple installations. The present invention fulfills these needs and provides other related advantages.

SUMMARY OF THE INVENTION

The present invention is directed to a light fixture wall mount that provides a low-profile installation for light fixtures, as well as, multiple options for orientation and direction of light fixtures. The light fixture wall mount or mounting body is a generally oblong body having a generally planar upper surface, a generally planar lower surface, and a generally planar mounting face. The upper surface and the lower surface are oriented generally parallel to each other and are co-extensive in a long dimension of the oblong body. The mounting face is oriented generally perpendicular to the upper surface and the lower surface. A stem port extends through the oblong body from the upper surface to the lower surface. A transverse port extends through the oblong body from the mounting face to the stem port.

The stem port preferably has internally threaded openings in both the upper surface and the lower surface, which opening are configured to receive stems or other mounting features on a light fixture. The transverse port provides a passageway through the oblong body from an opening in the mounting face to the stem port. A dividing wall is preferably provided in the transverse port extending from the mounting face to the stem port. The dividing wall separates the transverse port into two separate passageways. The dividing wall preferably extends through the stem port.

The internally threaded openings on the stem port are each configured to receive a threaded mounting stem from a light fixture. The wall mount preferably includes at least one threaded plug configured for selectively covering one of the internally threaded openings in either the upper surface or the lower surface.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
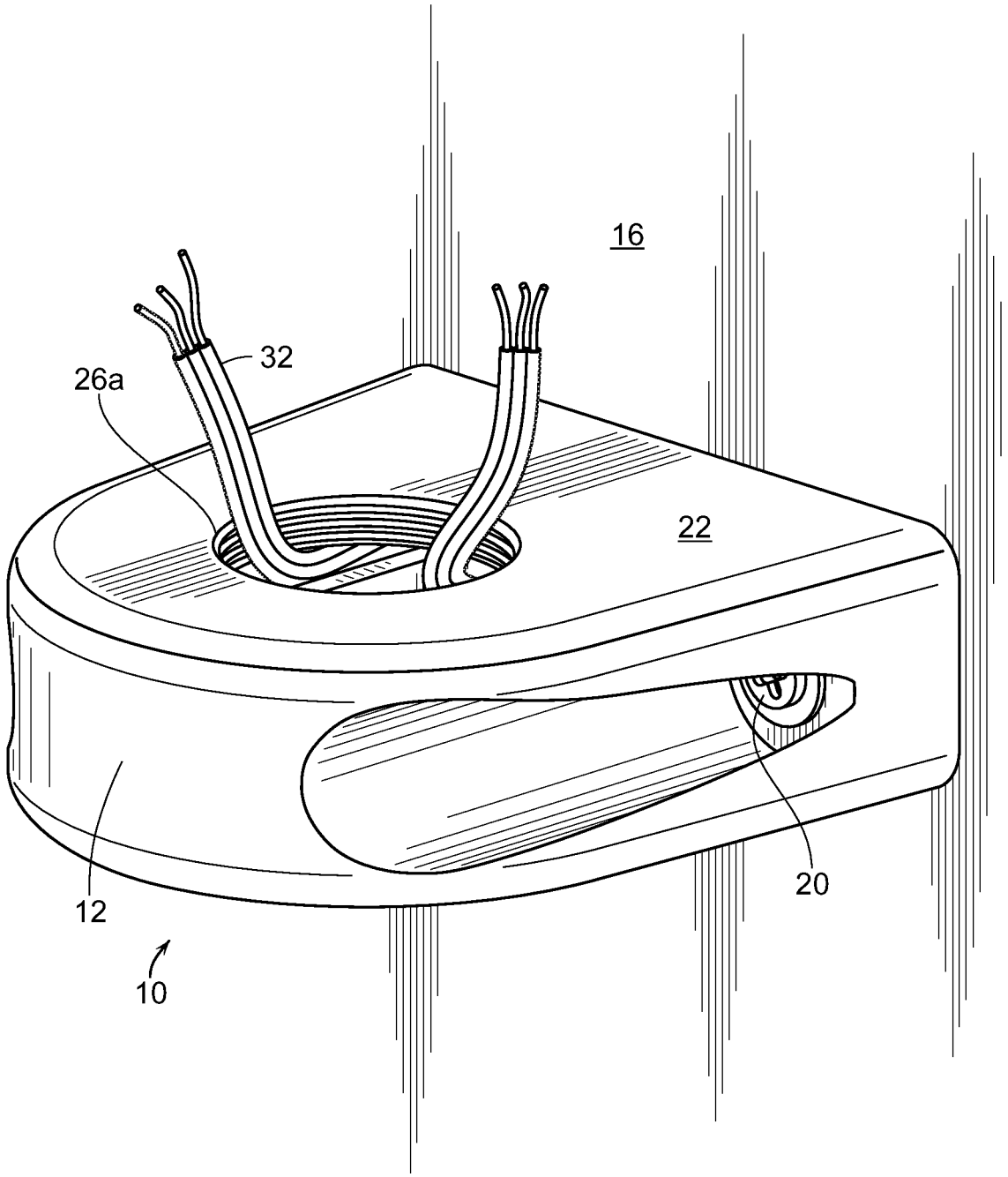
FIG. 1 is a perspective view of an installation of the wall mount according to the present invention.
Figure 2:
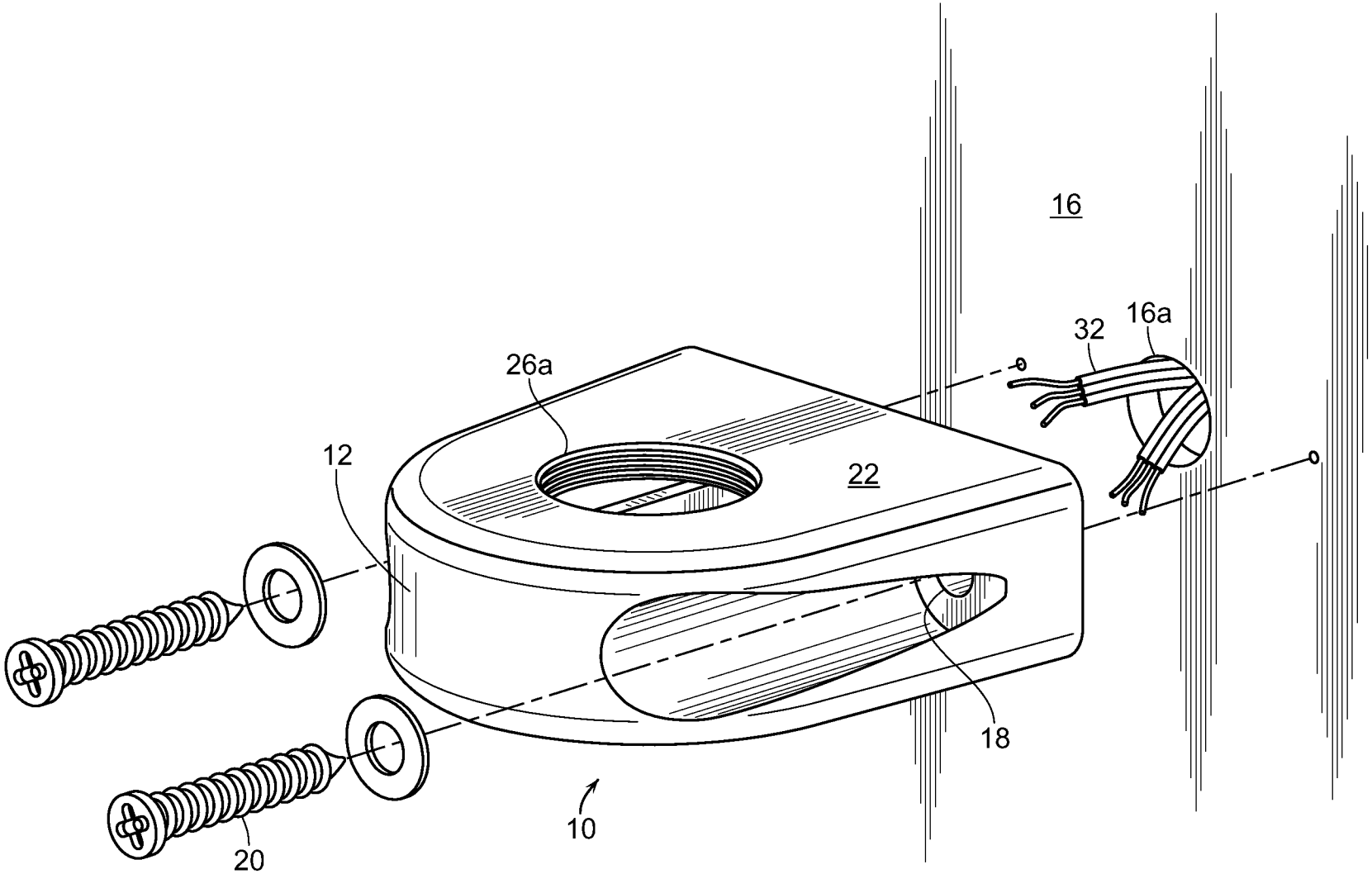
FIG. 2 is an exploded perspective view of the wall mount of FIG. 1.
Figure 3:
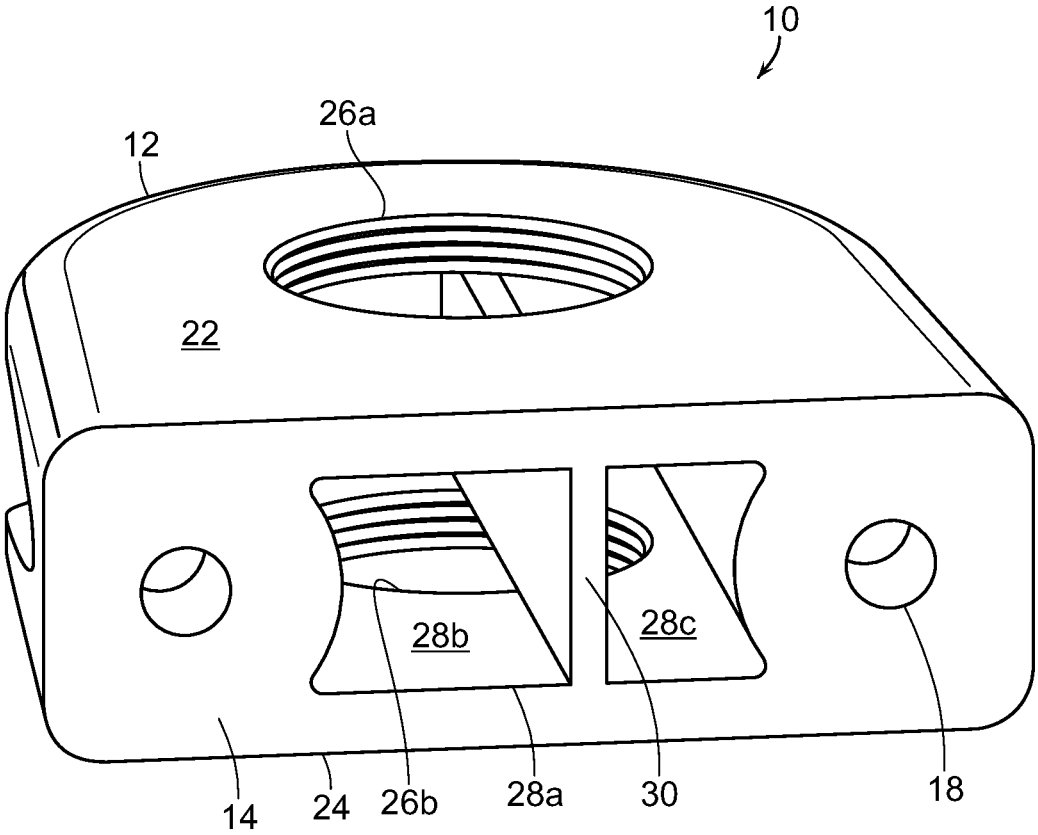
FIG. 3 is a rear view of the wall mount according to the present invention.
Figure 4:
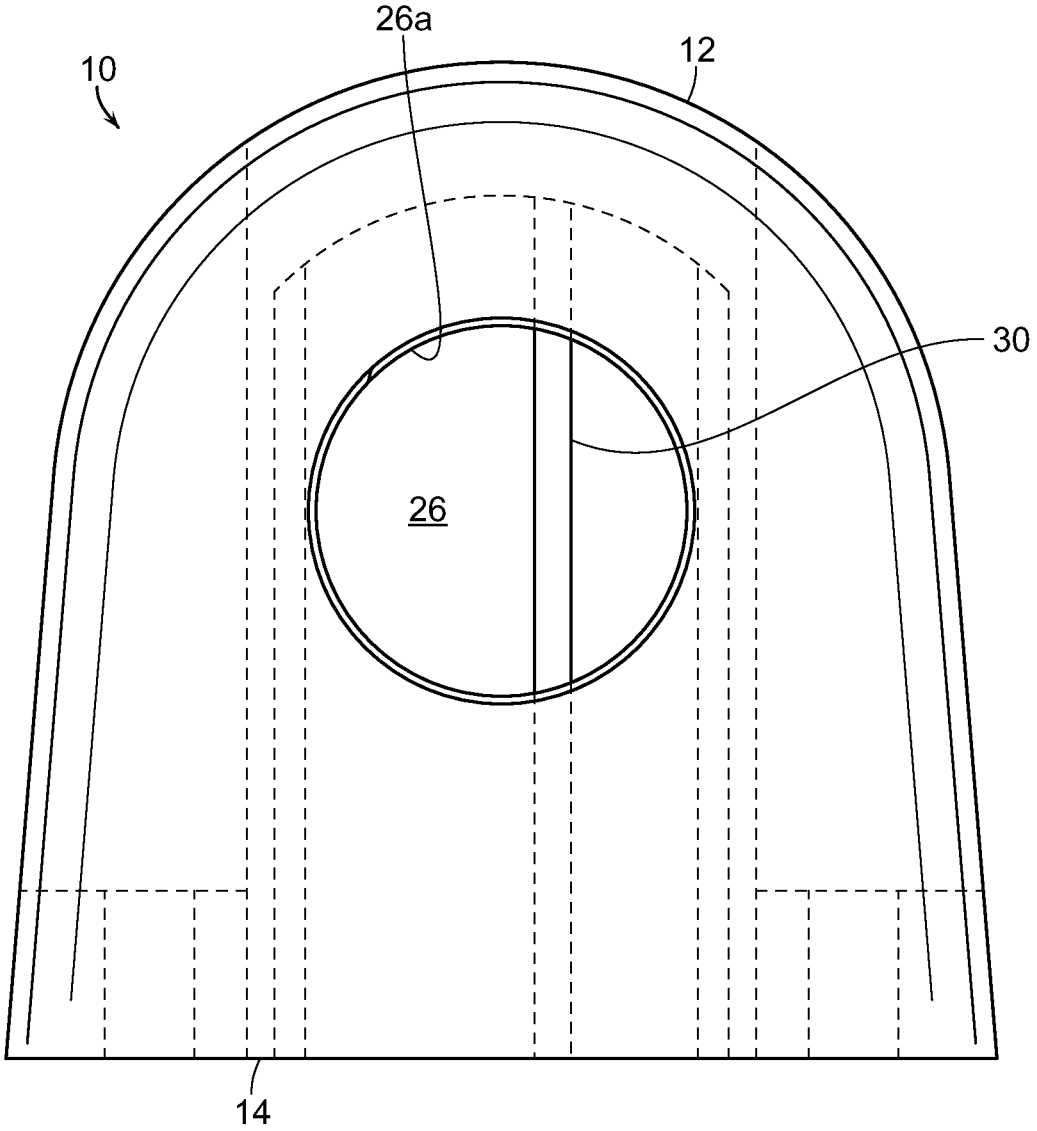
FIG. 4 is a top view of the wall mount according to the present invention.
Figure 5:
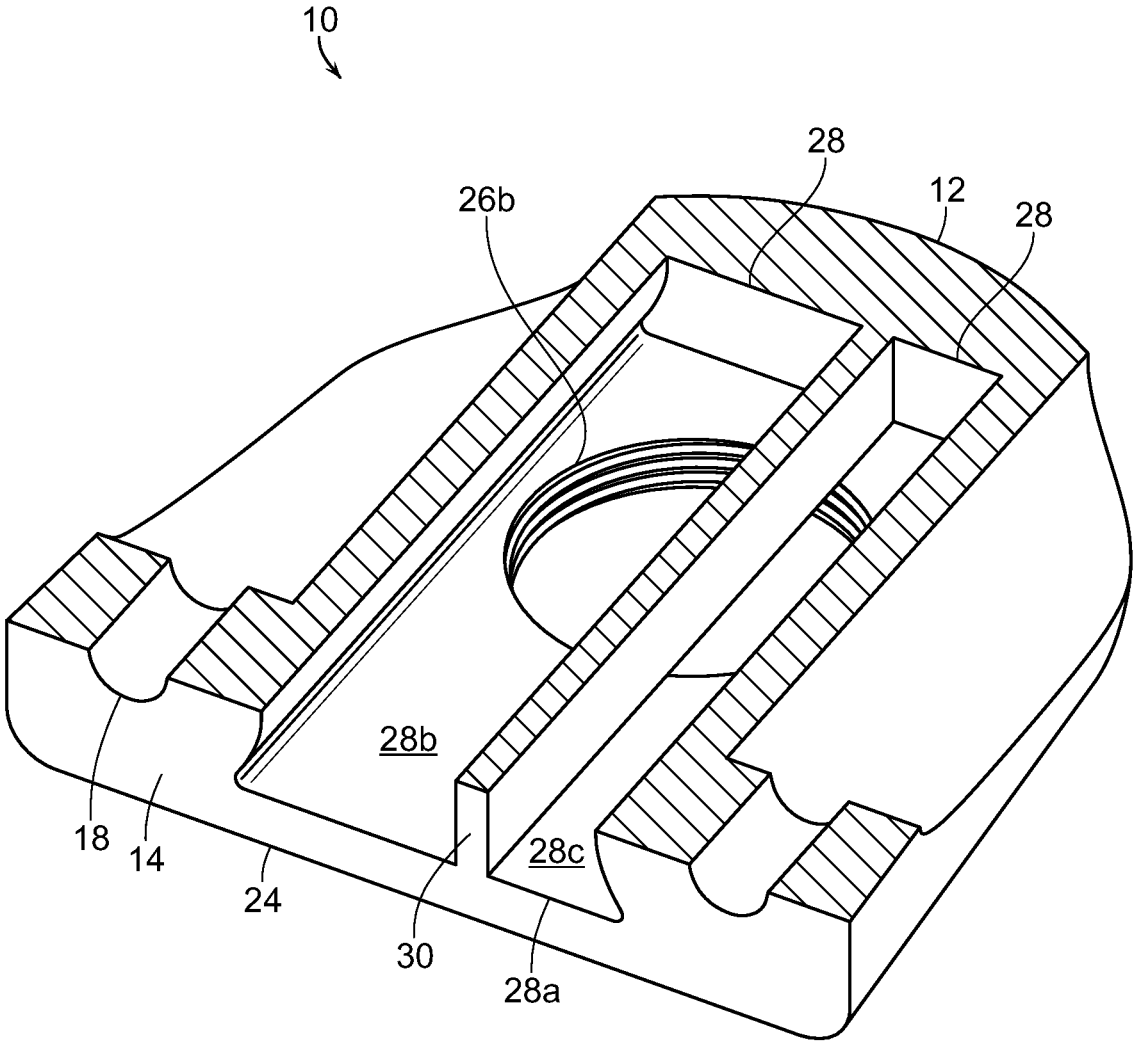
FIG. 5 is a cut-away, cross-sectional view of the wall mount shown in FIG. 3.

The present invention is directed to light fixture wall mount for use in lighting installations. In the following detailed description, the inventive wall mount will be generally referred to by reference numeral 10. FIGS. 1-8 generally show the wall mount 10 from multiple angles and in multiple installations. The wall mount 10 is intended for use in lighting installations so as to facilitate the installation of lighting fixtures in particular orientations that are less often possible, such that the lighting fixture can be more easily oriented to illuminate desired areas.

As shown in FIGS. 1-5, the wall mount 10 generally has a mounting body 12 with a generally flat or planar rear mounting surface 14. The rear mounting surface 14 is configured to abut against a wall 16 or other mounting surface, i.e., ceiling, eave, overhang. A pair of mounting ports 18 or similar mounting structures are provided on wall mount 10, configured to receive fasteners 20, i.e., screws or similar. The fasteners 20 with the mounting ports 18 cooperate to secure the wall mount 10 to the wall 16, preferably flush.

The body 12 has a generally oblong shape with the rear surface 14 being at one end of the long dimension of the oblong shape. The body 12 also has an upper surface 22 and an oppositely disposed lower surface 24. Both the upper and lower surfaces 22, 24 are generally planar, co-extensive with one another, and extend generally perpendicular to the rear surface 14.

A stem port 26 extends through the mounting body 12 from the upper surface 22 to the lower surface 24. The stem port 26 is configured to receive the stem or other mounting feature of a light fixture as described below. The stem port 26 preferably has a threaded opening 26*a* in at least one of the upper surface 22 or the lower surface 24. Preferably, the stem port 26 also has a threaded opening 26*b* in the other of the upper surface 22 or the lower surface 24. In this way, the wall mount 10 can receive a light fixture in the upper surface 22, the lower surface 24, or both, as described more fully below.

A transverse port 28 extends through most of the long dimension of the mounting body 12 from the rear surface 14. The transverse port 28 has an opening 28*a* in the rear surface 14. The transverse port 28 extends to at least the stem port 26 such that the opening 28*a* is in communication with the stem port 26 and either or both of the threaded opening 26*a*, 26*b*. A dividing wall 30 is preferably disposed in the transverse port 28 that extends from the opening 28*a* to or through the stem port 26. The dividing wall 30 separates the transverse port 28 into two separate passageways 28*b*, 28*c*.

Figure 6:
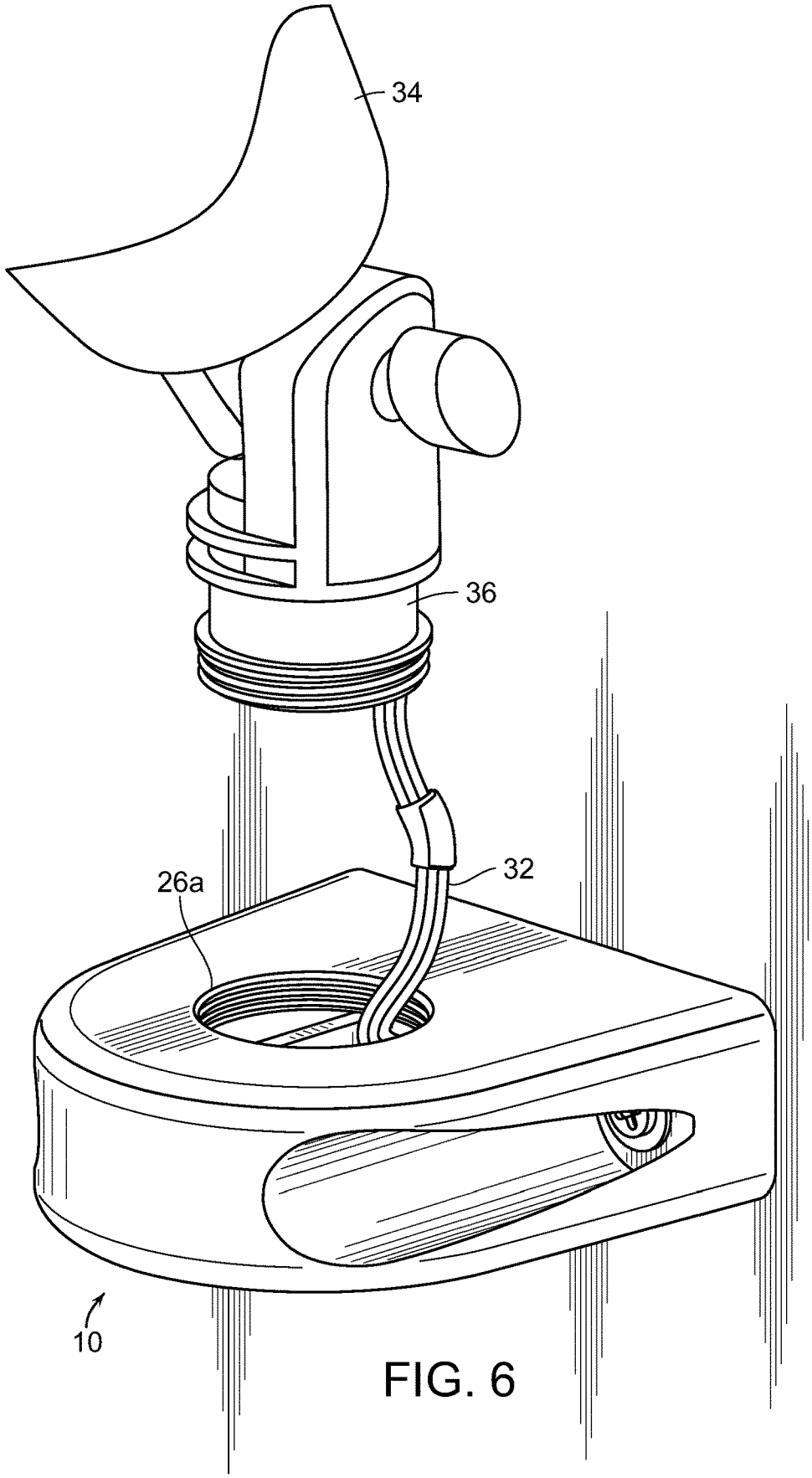
FIG. 6 is a perspective view of an installation of the wall mount according to the present invention including a connected light fixture.
Figure 7:
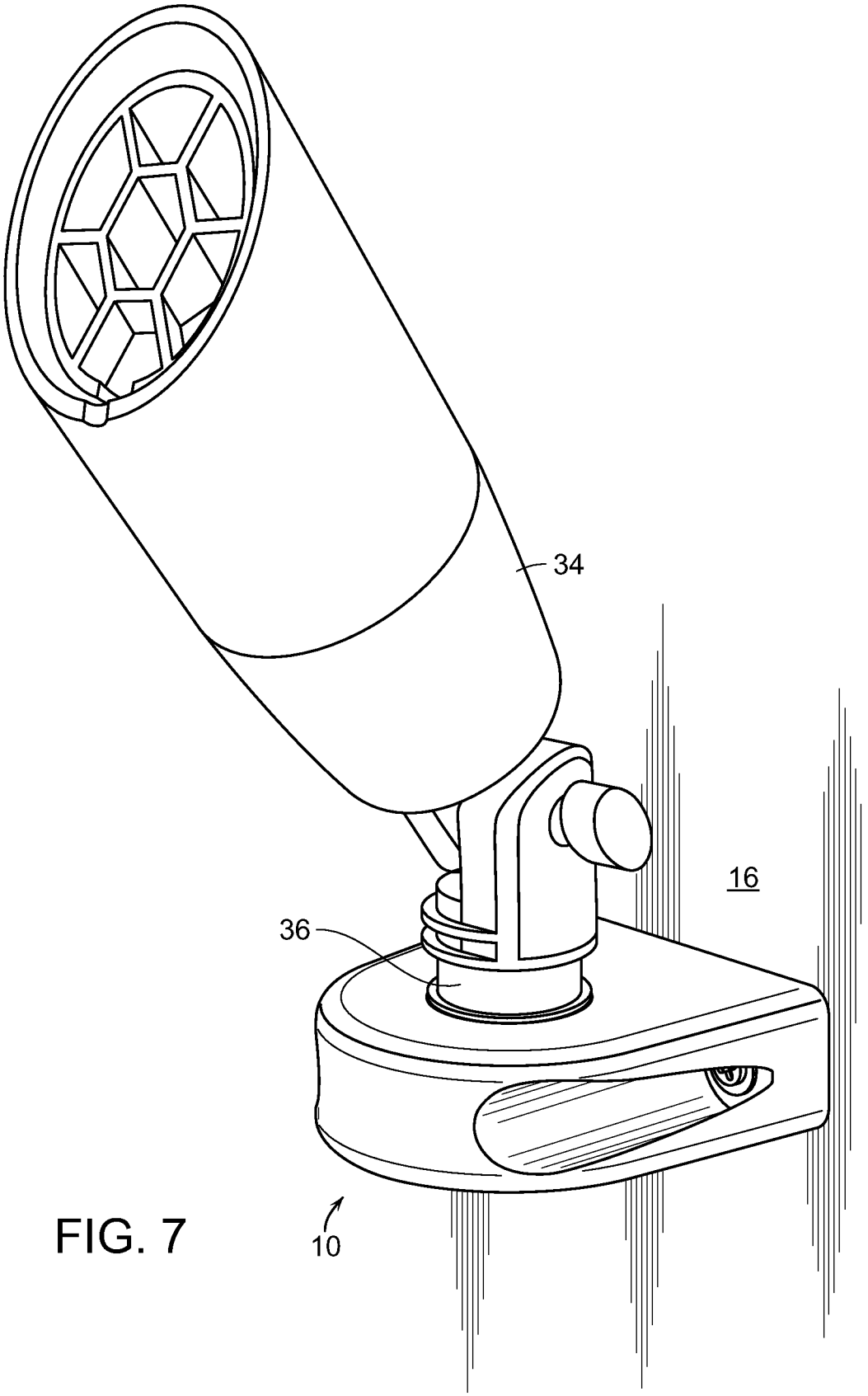
FIG. 7 is a perspective view of an installation of the wall mount according to the present invention including a connected light fixture.
Figure 8:
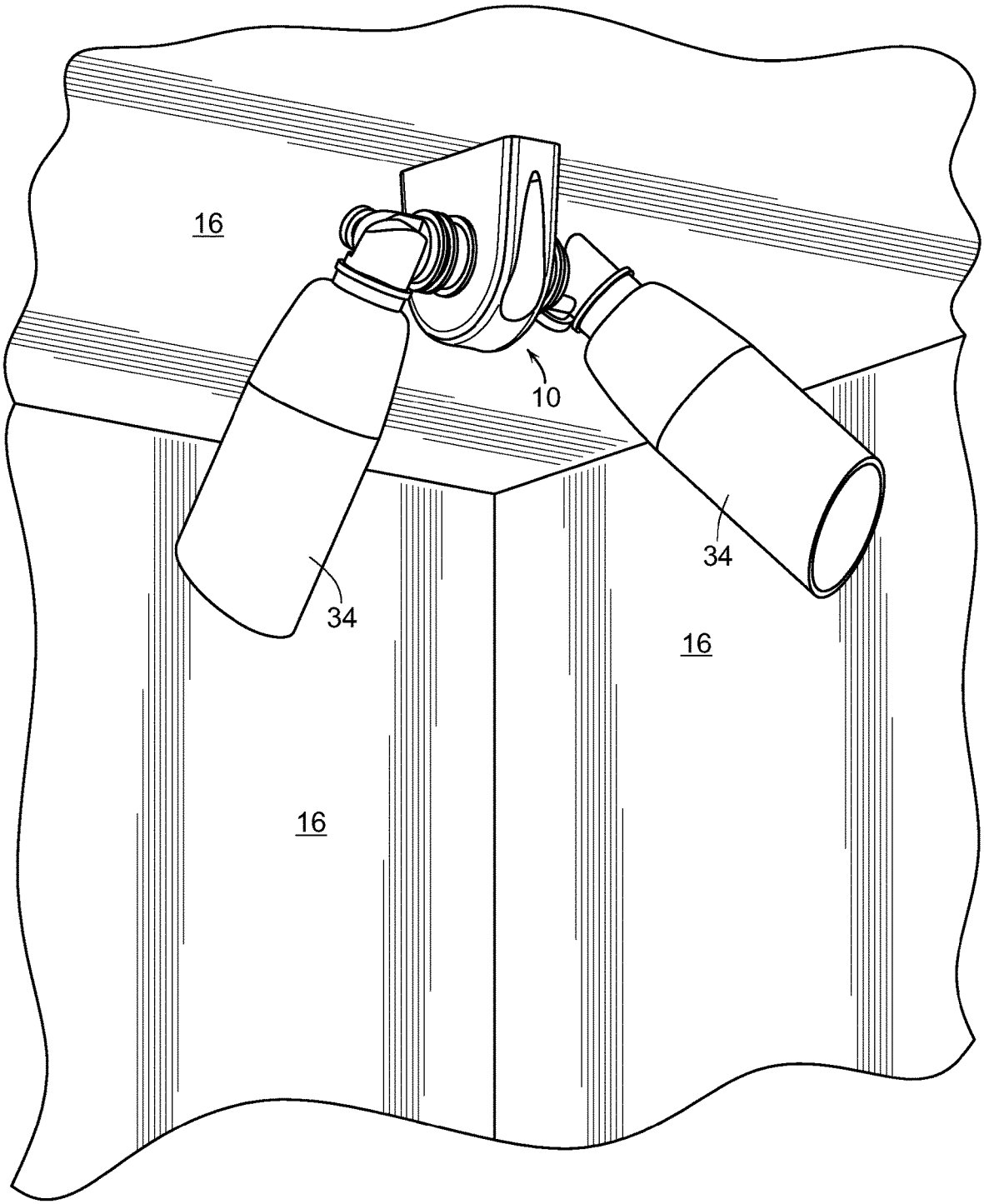
FIG. 8 is a perspective view of an installation of the wall mount according to the present invention including two connected light fixtures.

As shown in FIGS. 6-8, the wall mount 10 is configured to be mounted onto a wall 16 or other surface. Electrical wires 32 run through a hole 16*a* in the wall 16 are passed through the opening 28*a* and the transverse port 28 to the stem port 26. The electrical wires 32 may be run through one or both of the openings 26*a*, 26*b* and attached to a light fixture 34.

The separate passageways 28*b*, 28*c* in the transverse port 28 may facilitate separating the electrical wires 32 into hot/neutral and ground groupings, or separating electrical wires 32 from different switches for separate control of corresponding light fixtures 34. The light fixture 34 may be attached to the wall mount 10 by securing a threaded stem 36 into one of the threaded openings 26*a*, 26*b*. With adequate wiring, two light fixtures 34 can be attached to the same wall mount 10 using both of the threaded opening 26*a*, 26*b*.

In the manner described, the inventive wall mount 10 can be used in a single installation to provide multiple options for illumination. The wall mount 10 provides the option to install light fixtures 34 having either an upward or downward orientation, without having to flip, rotate, or otherwise adjust the wall mount 10 after installation. The wall mount 10 also provides the option of having oppositely oriented light fixtures 34 with a single wall mount 10 installation. The configuration also conceals the electrical wires 32 more easily compared to prior art light fixture mounts.

FIG. 8 illustrates an embodiment of the wall mount 10 wherein the same is installed on an overhang 16*a* with light fixtures 34 installed in each threaded opening 26*a*. In this manner, a single wall mount 10 installation can support two light fixtures 34 to illuminate different features.

While the foregoing uses upper/lower, upward/downward, and other directional terms, a person of ordinary skill in the art will understand that those terms are only intended to indicate relative opposite directions or orientations. The inventive wall mount 10 may be installed horizontally, vertically, on in any other directional orientation. Although several embodiments have been described in detail for purposes of illustration, various modifications may be made without departing from the scope and spirit of the invention.

What is claimed is:

1. A light fixture mounting body, comprising:

an oblong body having a generally planar upper surface, a generally planar lower surface, and a generally planar mounting face;

wherein the upper surface and the lower surface are oriented generally parallel to each other and are co-extensive in a long dimension of the oblong body;

wherein the mounting face is oriented generally perpendicular to the upper surface and the lower surface;

a stem port extending through the oblong body from the upper surface to the lower surface; and a transverse port and a dividing wall that completely separates the transverse port into a first passageway and a second passageway, both passageways extending through the oblong body from the mounting face to the stem port.

2. The mounting body of claim 1, wherein the stem port has internally threaded openings in both the upper surface and the lower surface.

3. The mounting body of claim 1, wherein the dividing wall extends through the stem port.

4. The mounting body of claim 2, wherein the internally threaded openings are each configured to receive a threaded mounting stem from a light fixture.

5. The mounting body of claim 2, further comprising a threaded plug configured for selectively covering one of the internally threaded openings in either the upper surface or the lower surface.

6. A light fixture mounting body, comprising:

an oblong body having a generally planar upper surface, a generally planar lower surface, and a generally planar mounting face;

wherein the upper surface and the lower surface are oriented generally parallel to each other and are co-extensive in a long dimension of the oblong body;

wherein the mounting face is oriented generally perpendicular to the upper surface and the lower surface;

a stem port extending through the oblong body from the upper surface to the lower surface, wherein the stem port has a first internally threaded opening in the upper surface; and a transverse port and a dividing wall that completely separates the transverse port into a first passageway and a second passageway, both passageways extending through the oblong body from an opening in the mounting face to the stem port.

7. The mounting body of claim 6, wherein the stem port further has a second internally threaded opening in the lower surface.

8. The mounting body of claim 6, wherein the dividing wall extends through the stem port.

9. The mounting body of claim 6, wherein the first internally threaded opening is configured to receive a threaded mounting stem from a light fixture.

10. The mounting body of claim 7, wherein the second internally threaded opening is configured to receive a threaded mounting stem from a light fixture.

11. The mounting body of claim 10, further comprising a second threaded plug configured for selectively covering the one of the first internally threaded opening or the second threaded opening.

* * * * *